US006705646B1

(12) United States Patent
Glassman

(10) Patent No.: US 6,705,646 B1
(45) Date of Patent: Mar. 16, 2004

(54) COMPACT MULTIYEAR CALENDAR

(76) Inventor: Terrence A. Glassman, 7 Fleet St., Suite 106, Marina Del Rey, CA (US) 90292

( * ) Notice: Subject to any disclaimer, the term of this patent is extended or adjusted under 35 U.S.C. 154(b) by 0 days.

(21) Appl. No.: 09/640,040

(22) Filed: Aug. 15, 2000

Related U.S. Application Data

(63) Continuation-in-part of application No. 09/082,326, filed on May 21, 1998, now Pat. No. 6,116,656.

(51) Int. Cl.[7] ..... B42D 5/04

(52) U.S. Cl. ..... 283/2; 283/4; 283/114; 40/107; 40/110; D19/20; D19/24; D19/25; 235/85 R

(58) Field of Search ..... 283/2, 4, 114; 40/107, 110; D19/20, 24, 25; 235/85 R

(56) References Cited

U.S. PATENT DOCUMENTS

| | | | | | |
|---|---|---|---|---|---|
| 1,239,220 | A | | 9/1917 | Roden | 283/2 |
| 1,470,065 | A | | 10/1923 | Downer | 40/107 |
| 1,494,133 | A | | 5/1924 | Ringler | 40/107 |
| 1,520,648 | A | * | 12/1924 | Holt | 40/107 |
| 1,558,020 | A | | 10/1925 | Lauer | 40/109 |
| 1,601,119 | A | | 9/1926 | Heaton | 40/117 |
| 1,608,411 | A | | 11/1926 | Mateju | 283/2 |
| 2,340,153 | A | * | 1/1944 | Stewart | 40/107 |
| 2,768,459 | A | | 10/1956 | Corbettq | 40/109 |
| 2,952,932 | A | * | 9/1960 | Beer | 40/113 |
| 3,605,307 | A | | 9/1971 | Dickson | 40/108 |
| 3,698,113 | A | | 10/1972 | Spicer | 40/118 |
| 3,936,966 | A | | 2/1976 | Zeiske | 40/109 |
| 4,015,351 | A | * | 4/1977 | Sasson | 40/110 |
| 4,226,443 | A | | 10/1980 | Brown | 283/2 |
| 4,244,126 | A | | 1/1981 | James | 40/112 |
| 4,285,147 | A | | 8/1981 | Kolar | 40/109 |
| 4,381,121 | A | * | 4/1983 | Hanley | 283/115 |
| 4,418,274 | A | * | 11/1983 | Masillo | 235/85 R |
| 4,472,893 | A | | 9/1984 | Curtis | 40/107 |
| 4,540,292 | A | | 9/1985 | Rubenstein et al. | 369/20 |
| D296,567 | S | | 7/1988 | Muramatsu | D19/20 |
| 4,793,080 | A | * | 12/1988 | Tangorra | 40/122 |
| 4,828,290 | A | * | 5/1989 | Harris | 283/67 |
| 4,863,193 | A | * | 9/1989 | Keshani | 283/2 |
| 5,016,917 | A | * | 5/1991 | Dubner et al. | 283/4 |
| 5,125,688 | A | * | 6/1992 | Bianco | 283/2 |
| 5,313,723 | A | | 5/1994 | Cregg | 40/113 |
| 5,457,903 | A | | 10/1995 | Lopez | 40/109 |
| 5,655,319 | A | | 8/1997 | LeCompte | 40/107 |
| 5,690,364 | A | * | 11/1997 | Oleske et al. | 283/2 |
| 5,787,745 | A | | 8/1998 | Chang | 70/456 R |
| 5,930,924 | A | * | 8/1999 | Beard | 40/107 |
| 6,089,607 | A | * | 7/2000 | Keeney et al. | 281/2 |
| 6,550,165 | B2 | * | 4/2003 | Chirafesi, Jr. | 40/113 |
| D476,361 | S | * | 6/2003 | Lester | D19/20 |

* cited by examiner

*Primary Examiner*—A. L. Wellington
*Assistant Examiner*—Mark T. Henderson
(74) *Attorney, Agent, or Firm*—Koppel, Jacobs, Patrick & Heybl; Michael J. Ram

(57) ABSTRACT

A multiyear calendar in the form of a multipage, book-like assembly with a standard page and 14 leaves on top thereof, each leaf rotatable along an edge seam to expose another leaf below. The standard page has a two dimensional array which graphically presents the basic information of the day and date for any given month in any given year. Each of the leaves lists the years for which it is used and a vertical array of 12 symbols each designating a month of the year and usable, in conjunction with the standard page, to determine the first day of each month.

2 Claims, 9 Drawing Sheets

PERPETUAL CALENDER SCHEDULE

| REGULAR YEARS | | | | | | | LEAP YEARS | | | | | | |
|---|---|---|---|---|---|---|---|---|---|---|---|---|---|
| 1 | 2 | 3 | 4 | 5 | 6 | 7 | 8 | 9 | 10 | 11 | 12 | 13 | 14 |
| ---- | 1821 | 1822 | 1823 | ---- | ---- | 1825 | ---- | ---- | ---- | ---- | 1824 | ---- | ---- |
| 1826 | 1827 | ---- | ---- | 1829 | 1830 | 1831 | ---- | ---- | 1828 | ---- | ---- | ---- | ---- |
| ---- | ---- | 1833 | 1834 | 1835 | ---- | ---- | 1832 | ---- | ---- | ---- | ---- | 1836 | ---- |
| 1837 | 1838 | 1839 | ---- | ---- | 1841 | 1842 | ---- | ---- | ---- | 1840 | ---- | ---- | ---- |
| 1843 | ---- | ---- | 1845 | 1846 | 1847 | ---- | ---- | 1844 | ---- | ---- | ---- | ---- | 1848 |
| ---- | 1849 | 1850 | 1851 | ---- | ---- | 1853 | ---- | ---- | ---- | ---- | 1852 | ---- | ---- |
| 1854 | 1855 | ---- | ---- | 1857 | 1858 | 1859 | ---- | ---- | 1856 | ---- | ---- | ---- | ---- |
| ---- | ---- | 1861 | 1862 | 1863 | ---- | ---- | 1860 | ---- | ---- | ---- | ---- | 1864 | ---- |
| 1865 | 1866 | 1867 | ---- | ---- | 1869 | 1870 | ---- | ---- | ---- | 1868 | ---- | ---- | ---- |
| 1871 | ---- | ---- | 1873 | 1874 | 1875 | ---- | ---- | 1872 | ---- | ---- | ---- | ---- | 1876 |
| ---- | 1877 | 1878 | 1879 | ---- | ---- | 1881 | ---- | ---- | ---- | ---- | 1880 | ---- | ---- |
| 1882 | 1883 | ---- | ---- | 1885 | 1886 | 1887 | ---- | ---- | 1884 | ---- | ---- | ---- | ---- |
| ---- | ---- | 1889 | 1890 | 1891 | ---- | ---- | 1888 | ---- | ---- | ---- | ---- | 1892 | ---- |
| 1893 | 1894 | 1895 | ---- | ---- | 1897 | 1898 | ---- | ---- | ---- | 1896 | ---- | ---- | ---- |
| 1899 | 1900 | 1901 | 1902 | 1903 | ---- | ---- | ---- | ---- | ---- | ---- | ---- | 1904 | ---- |
| 1905 | 1906 | 1907 | ---- | ---- | 1909 | 1910 | ---- | ---- | ---- | 1908 | ---- | ---- | ---- |
| 1911 | ---- | ---- | 1913 | 1914 | 1915 | ---- | ---- | 1912 | ---- | ---- | ---- | ---- | 1916 |
| ---- | 1917 | 1918 | 1919 | ---- | ---- | 1921 | ---- | ---- | ---- | ---- | 1920 | ---- | ---- |
| 1922 | 1923 | ---- | ---- | 1925 | 1926 | 1927 | ---- | ---- | 1924 | ---- | ---- | ---- | ---- |
| ---- | ---- | 1929 | 1930 | 1931 | ---- | ---- | 1928 | ---- | ---- | ---- | ---- | 1932 | ---- |
| 1933 | 1934 | 1935 | ---- | ---- | 1937 | 1938 | ---- | ---- | ---- | 1936 | ---- | ---- | ---- |
| 1939 | ---- | ---- | 1941 | 1942 | 1943 | ---- | ---- | 1940 | ---- | ---- | ---- | ---- | 1944 |
| ---- | 1945 | 1946 | 1947 | ---- | ---- | 1949 | ---- | ---- | ---- | ---- | 1948 | ---- | ---- |

FIG. 3A

PERPETUAL CALENDER SCHEDULE

| REGULAR YEARS | | | | | | | LEAP YEARS | | | | | | |
|---|---|---|---|---|---|---|---|---|---|---|---|---|---|
| 1 | 2 | 3 | 4 | 5 | 6 | 7 | 8 | 9 | 10 | 11 | 12 | 13 | 14 |
| 1950 | 1951 | ---- | ---- | 1953 | 1954 | 1955 | ---- | ---- | 1952 | ---- | ---- | ---- | ---- |
| ---- | ---- | 1957 | 1958 | 1959 | ---- | ---- | 1956 | ---- | ---- | ---- | ---- | 1960 | ---- |
| 1961 | 1962 | 1963 | ---- | ---- | 1965 | 1966 | ---- | ---- | ---- | 1964 | ---- | ---- | ---- |
| 1967 | ---- | ---- | 1969 | 1970 | 1971 | ---- | ---- | 1968 | ---- | ---- | ---- | ---- | 1972 |
| ---- | 1973 | 1974 | 1975 | ---- | ---- | 1977 | ---- | ---- | ---- | ---- | 1976 | ---- | ---- |
| 1978 | 1979 | ---- | ---- | 1981 | 1982 | 1983 | ---- | ---- | 1980 | ---- | ---- | ---- | ---- |
| ---- | ---- | 1985 | 1986 | 1987 | ---- | ---- | 1984 | ---- | ---- | ---- | ---- | 1988 | ---- |
| 1989 | 1990 | 1991 | ---- | ---- | 1993 | 1994 | ---- | ---- | ---- | 1992 | ---- | ---- | ---- |
| 1995 | ---- | ---- | 1997 | 1998 | 1999 | ---- | ---- | 1996 | ---- | ---- | ---- | ---- | 2000 |
| ---- | 2001 | 2002 | 2003 | ---- | ---- | 2005 | ---- | ---- | ---- | ---- | 2004 | ---- | ---- |
| 2006 | 2007 | ---- | ---- | 2009 | 2010 | 2011 | ---- | ---- | 2008 | ---- | ---- | ---- | ---- |
| ---- | ---- | 2013 | 2014 | 2015 | ---- | ---- | 2012 | ---- | ---- | ---- | ---- | 2016 | ---- |
| 2017 | 2018 | 2019 | ---- | ---- | 2021 | 2022 | ---- | ---- | ---- | 2020 | ---- | ---- | ---- |
| 2023 | ---- | ---- | 2025 | 2026 | 2027 | ---- | ---- | 2024 | ---- | ---- | ---- | ---- | 2028 |
| ---- | 2029 | 2030 | 2031 | ---- | ---- | 2033 | ---- | ---- | ---- | ---- | 2032 | ---- | ---- |
| 2034 | 2035 | ---- | ---- | 2037 | 2038 | 2039 | ---- | ---- | 2036 | ---- | ---- | ---- | ---- |
| ---- | ---- | 2041 | 2042 | 2043 | ---- | ---- | 2040 | ---- | ---- | ---- | ---- | 2044 | ---- |
| 2045 | 2046 | 2047 | ---- | ---- | 2049 | 2050 | ---- | ---- | ---- | 2048 | ---- | ---- | ---- |
| 2051 | ---- | ---- | 2053 | 2054 | 2055 | ---- | ---- | 2052 | ---- | ---- | ---- | ---- | 2056 |
| ---- | 2057 | 2058 | 2059 | ---- | ---- | 2061 | ---- | ---- | ---- | ---- | 2060 | ---- | ---- |
| 2062 | 2063 | ---- | ---- | 2065 | 2066 | 2067 | ---- | ---- | 2064 | ---- | ---- | ---- | ---- |
| ---- | ---- | 2069 | 2070 | 2071 | ---- | ---- | 2068 | ---- | ---- | ---- | ---- | 2072 | ---- |
| 2073 | 2074 | 2075 | ---- | ---- | 2077 | 2078 | ---- | ---- | ---- | 2076 | ---- | ---- | ---- |
| 2079 | ---- | ---- | ---- | ---- | ---- | ---- | ---- | 2080 | ---- | ---- | ---- | ---- | ---- |

FIG. 3B

| | | | | | | |
|---|---|---|---|---|---|---|
| 3 | 1901 | 1929 | 1957 | 1985 | 2013 | 2041 |
| 4 | 1902 | 1930 | 1958 | 1986 | 2014 | 2042 |
| 5 | 1903 | 1931 | 1959 | 1987 | 2015 | 2043 |
| 13 * | 1904 | 1932 | 1960 | 1988 | 2016 | 2044 |
| 1 | 1905 | 1933 | 1961 | 1989 | 2017 | 2045 |
| 2 | 1906 | 1934 | 1962 | 1990 | 2018 | 2046 |
| 3 | 1907 | 1935 | 1963 | 1991 | 2019 | 2047 |
| 11 * | 1908 | 1936 | 1964 | 1992 | 2020 | 2048 |
| 6 | 1909 | 1937 | 1965 | 1993 | 2021 | 2049 |
| 7 | 1910 | 1938 | 1966 | 1994 | 2022 | 2050 |
| 1 | 1911 | 1939 | 1967 | 1995 | 2023 | |
| 9 * | 1912 | 1940 | 1968 | 1996 | 2024 | |
| 4 | 1913 | 1941 | 1969 | 1997 | 2025 | |
| 5 | 1914 | 1942 | 1970 | 1998 | 2026 | |
| 6 | 1915 | 1943 | 1971 | 1999 | 2027 | |
| 14 * | 1916 | 1944 | 1972 | 2000 | 2028 | |
| 2 | 1917 | 1945 | 1973 | 2001 | 2029 | |
| 3 | 1918 | 1946 | 1974 | 2002 | 2030 | |
| 4 | 1919 | 1947 | 1975 | 2003 | 2031 | |
| 12 * | 1920 | 1948 | 1976 | 2004 | 2032 | |
| 7 | 1921 | 1949 | 1977 | 2005 | 2033 | |
| 1 | 1922 | 1950 | 1978 | 2006 | 2034 | |
| 2 | 1923 | 1951 | 1979 | 2007 | 2035 | |
| 10 * | 1924 | 1952 | 1980 | 2008 | 2036 | |
| 5 | 1925 | 1953 | 1981 | 2009 | 2037 | |
| 6 | 1926 | 1954 | 1982 | 2010 | 2038 | |
| 7 | 1927 | 1955 | 1983 | 2011 | 2039 | |
| 8 * | 1928 | 1956 | 1984 | 2012 | 2040 | |

*Leap year

FIG. 6

COMPACT MULTIYEAR CALENDAR

This is a continuation-in-part of U.S. Ser. No. 09/082,326, filed May 21, 1998, now U.S. Pat. No. 6,116,656.

BACKGROUND OF THE INVENTION

1. Area of the Art

The present invention relates to devices which are used to help a user determine the month, date, day and year, or, in certain embodiments, multiyear calendars. Specifically, the present invention relates to coded printed displays for calendaring effective for use as wall calendars, color coded diaries, electronic desk calendars, computer implemented or controlled calendaring systems and the like means for calendaring.

2. Description of the Prior Art

Since the dawn of recorded time man has endeavored to utilize systems to track daily, weekly, monthly and yearly events. A calendarium, or rudimentary accounting book, originally allowed people to maintain in proper order the days on which accounts were due. A calendar may be generally defined as a system according to which the beginning and length of years, including subdivisions thereof, can be fixed. (The Oxford Universal Dictionary, 8th Edition, 1995, p. 349). Likewise, calendars may be characterized as tables showing the months, days of the week and dates of a given year—often specialized, and sometimes including more than one series of detailed tables. (Webster□s Third New Int. Dictionary, 1971, p. 316).

The Julian Calendar was introduced by Julius Caesar in B.C. 46 and is based upon the ordinary year having 365 days, with every fourth year being a leap year having 366 days. This may be contrasted with the Gregorian Calendar which modified the Julian Calendar with reference to astronomical data and the natural course of the seasons. The Gregorian Calendar was introduced by Pope Gregory XIII in A.D. 1582, and adopted in Great Britain in 1752.

The advances in both hardware and software technology have yet to provide any universal calendaring system allowing both rapid and accurate interface for disparate users. Accordingly, calendars having applicability for more than one monthly time period remain a longstanding need of most people in the modern world. Further, to provide these functions in a visually stimulating or easily readable format remains a prominent need among the studied art.

The following pertinent United States Letters Patents disclose calendar systems with a similar intent. However, the disclosure of each of said patents has been reviewed, examined and found to be technically distinguishable from the teachings of the instant invention as disclosed hereinafter.

U.S. Pat. No. DES. 296,567, issued Jul. 5, 1988 to Muramatsu, disclosed a hanging board calendar having four discrete sections joined together in a vertical plane by a fanciful rope member. There are no universal or perpetual aspects to this disclosure. In contradistinction, the teachings of the present invention are not limited, to a discrete series of years or one arrangement thereof. Rather the teachings of the present invention manifest themselves in a plurality of alternate ornamental arrangements, as set forth below, in combination with universal or perpetually applicable coded variables for allowing a user to rapidly extract month, day and date information.

U.S. Pat. No. 5,457,903, issued Oct. 17, 1995 to Lopez, disclosed a perpetual mechanical calendar having a front board having 12 windows and a sliding plate. The sliding plate was designed to move horizontally between seven different positions corresponding to years which begin on each day of the week. Additionally, the sliding member was arranged such that it could be raised to accommodate for differences between a standard year and a leap year. It is noted that oval shaped members 222 in FIG. 1 are transparent members. The mechanical nature of this disclosure and complexity thereof, in combination with the difficulty inherent in reading the same differentiate it from the teachings of the present invention.

U.S. Pat. No. 5,313,723, issued May 24, 1994 to Cregg, disclosed a perpetual calendar in the form of first and second, concentric, rotatable disks. The first disk has indicia representing the various days of the week and lead lines which function as pointers. The second disk includes a day number grid, The second disk is rotated relative to the first disk to the desired position to position the month grid adjacent the appropriate position year position line. This patent's disclosure combines too many elements to create an immediately accessible visual image which a user can access instantly such as taught by the present invention.

U.S. Pat. No. 4,540,292, issued Sep. 10, 1985 to Rubenstein et al., disclosed an electronic calendar in which each column corresponds to a particular day of the week. Each column has electronic display segments which can be programmed to display a number corresponding to the day of the month. Seven display elements are used to form a row representing a week and six such rows represent a month. The preferred embodiment includes a microprocessor and components to program messages. However, nothing in this disclosure was directed toward any universal mode of applicability.

U.S. Pat. No. 4,285,147, issued Aug. 25, 1981 to Kolar, disclosed an apparatus having two elongated moveable members which are provided with indication members for individual calendar dates. The desired date is provided by positioning the two members relative to each other according to a code marking the desired month. Likewise, according to this disclosure the user's needs for inputting more information and changing settings differentiates the same from the teachings of the present invention.

U.S. Pat. No. 4,226,443 to Brown discloses a multi-month calendar in the format of a single month calendar having a two dimensional matrix. One direction of the matrix represents the day of a week having seven sections. The other direction comprises color coded month/day graphic indicia with each box of the matrix divided into triangular graphic portions or other geometric shapes such that each month/day will standout on its own. A legend, in the form of rectangularly shaped color codes is keyed to the coded graphic image. A user need only to identify the month by the color code, and then to refer the multi-month calendar to observe a desired or given day of an applicable month. The patent shows a two, three or four month display. The more months intended to be covered, the more complicated and difficult the calendar system is to read. Visually confusing images inherent in this patent differentiates the same from the instant teachings.

U.S. Pat. No. 3,936,966, issued Feb. 10, 1976 to Zeiske, disclosed a perpetual calendar for separating two digits of the designated year. The calendar uses a means which can be a device having sliding flat, elongated elements, rotating circular elements, conical elements, separate cards, plates or other similar components which are capable of meshing to move relative to each other to display selected indicia. The concept is to use three elements to form the year, such as for example "19"+"7"+"3" for the year—1973—.

The calendar in U.S. Pat. No. 3,936,966 also employs the concept of sub-categorization to divide time into various calendric time units such as century, decade, Year, Month. All of these elements are assembled on printed forms which are assembled to provide discrete viewing areas of discrete printed data to form the date in a selected month of a designated year. This differs from applicant's teachings which are present in an integrated two dimensional matrix.

It is noted that, excepting U.S. Pat. Nos. 4,226,443 and 4,540,292, each of the above listed patents appear to be based on the use of printed members and relative movement between members to form a month in a designated year for displaying the designated date, which differentiates each of the same from the instant teachings as set forth more fully below.

U.S. Pat. No. 4,226,443, issued Oct. 7, 1990 to Brown, disclosed use of triangular-shaped, coded sections and a separate legend showing triangular divisions of a plurality of associated squared regions for a month corresponding to the month sections on the calendar for a designated year. However, this patent was directed to a multi-month calendar wherein the entire arrangement was compacted into a single month sheet. The confines of rectangular space defined the blocks and a complicated series of date divisions were disposed in each block. The crowded visual impression, and difficulty at readily discerning and desired data point from a quick viewing readily distinguishes this patent from the teachings of the present invention.

Likewise, U.S. Pat. No. 4,540,292, which issued Sep. 10, 1985 to Rubenstein et al., is a microprocessor controlled device for generating digital data and displaying the date for a selected month in a designated year. The microprocessor can generate data for any year thereby making it a perpetual calendar generating device.

U.S. Pat. No. 1,520,648 to Holt shows a calendar for a single year, which is a 12 by 31 spot array. It includes holes for insertion of pegs denoting days of the week or special events. This calendar provides no means for determining the day each date falls on, which must be provided by a second calendar. Further, the product disclosed can not be used to determine the calendar for a different year as it is designed to show only a single year.

However, none of the above described references provide the features of the present invention disposed within a concise two-dimensional matrix or are otherwise effective for correlating information using the unique symbol or color coded variable system of the present invention. Accordingly, the longstanding need for a universal symbol or color coded calendaring system having an interchangeable nature which makes it have perpetual applicability is solved in a heretofore unprecedented manner.

SUMMARY OF THE INVENTION

The present inventor has satisfied the longstanding need for a visually accessible perpetual means for calendaring, and according to a feature of the present invention there is provided a calendar, comprising; a first array of coded symbols including means for selectively accessing indicia denoting days of the week in any given month, and a set of coded symbols denoting months of the year, said array and set in combination defining a calendar for a given year.

Likewise, the present invention features a method of determining information regarding a selected day, date and month of the year comprising: a first array of twelve symbols assembled in a vertical row, the positioning of the symbol in the vertical row corresponding to a different month of the year, said months being in their normal order, and a second array of seven symbols in seven vertical columns, each of the columns comprising the seven symbols in a repetitive vertical arrangement of 31 symbols, each column representing a different day of the week, the days being in their normal order, and the vertical arrangement of 31 symbols representing the days of the month; identifying the symbol for the selected month on the first array and locating that same symbol on the second array to determine desired day or date the desired information related thereto.

Additionally, it is an object of the present invention to provide a means for presenting graphically an entire year in a two dimensional matrix, which means can be used as a perpetual calendar.

Another object is to provide a compact, easily readable means for calendaring which overcomes the drawbacks of the prior art.

An additional object of the present invention is to correlate the basic information of the month, date and day for a given year and to offer the same for a user's consideration on a coded variable basis allowing use of the matrix for any given year.

Yet another object of the present invention is to provide a perpetual calendar that is effective for covering both standard and leap years.

Yet a still further object of the present invention is to provide the above objects in a computer accessible calendar system enabling a user to perform basic calendar functions and to access data of choice that is based upon, or derived from date information.

These, and still further objects, are addressed hereinafter.

Briefly stated, the foregoing objects are attained generally, in the present invention, by a perpetual symbol coded means for calendaring, presenting, in a first embodiment, a two dimensional 7×31 matrix which graphically presents the basic information of the month, day and date for a given year. The indicia in the vertical columns of the matrix represent the dates of the month while the horizontal indicia represent the days of the week. Each month is designated in a legend by a selected symbol, such as a particular design or color, which coordinates with the indicia in the 7×31 array. A method of use, including a means for extrapolation of any desired yearly information into the present invention is taught in addition to software means for implementing the same.

According to a feature of the present invention, there is provided by a set of symbols or colors a coded perpetual calendar, comprising, in combination; a plurality of arrays of coded symbols for specifying information relative to a specific year, means for selectively accessing indicia denoting days of the week, means for selectively accessing, indicia denoting months of the year, conversion means for changing said plurality of arrays of coded symbols to designate variable information corresponding to a different year.

According to an additional feature of the present invention, there is provided a method of identifying information relating to a day, date, month and year, which comprises providing an array of columns including a first column having 12 symbols arranged in a vertical row, a vertical column of numbers 1 though 31, and 7 further columns further comprising 31 symbols; noting the design or color of a desired datum; comparing said color with the array; identifying desired day, month and year information; and repeating said identifying step.

According to yet a still further feature of the present invention, there is provided a device for symbolically arraying calendaring data comprising: a table for displaying a plurality of rows of data; a means for selecting a data string associated therewith; a means for repeating said step of selecting; a means for updating said table and a means for changing said table to display an alternate year.

The invention also includes a method for the filing and accessing of date related information to calendar dates by manual electronic or computer means where the calendar dates are designated by a printed or electronic 7×31 array of seven distinguishable indicia, said indicia being coordinated with like indicia identifying the months of the year. The seven distinguishable indicia are preferentially seven different colored spots.

BRIEF DESCRIPTION OF THE FIGURES

The invention is hereinafter described with reference to the accompanying drawings in which:

FIGS. 3*a* and 3*b* are a numerical array which is used in conjunction with FIG. 2, to isolate any selected month indicator for regular and leap calendar years from 1821 through 2080 according to an embodiment of the present invention;

FIG. 6 is numerical array with all of the information of FIGS. 3*a* and 3*b* with the further inclusion of a symbol for determining the day of January 1 of each particular year in the 150 year calendar.

FIGS. 7*a*–7*n* each display a particular set of years and the month indicators for the calendar of those years from the 150 year calendar, the month indicators of FIGS. 7*a*–7*n* corresponding to the columns labeled 1–14 in FIG. 2.

DETAILED DESCRIPTION OF THE INVENTION

Figure 1:
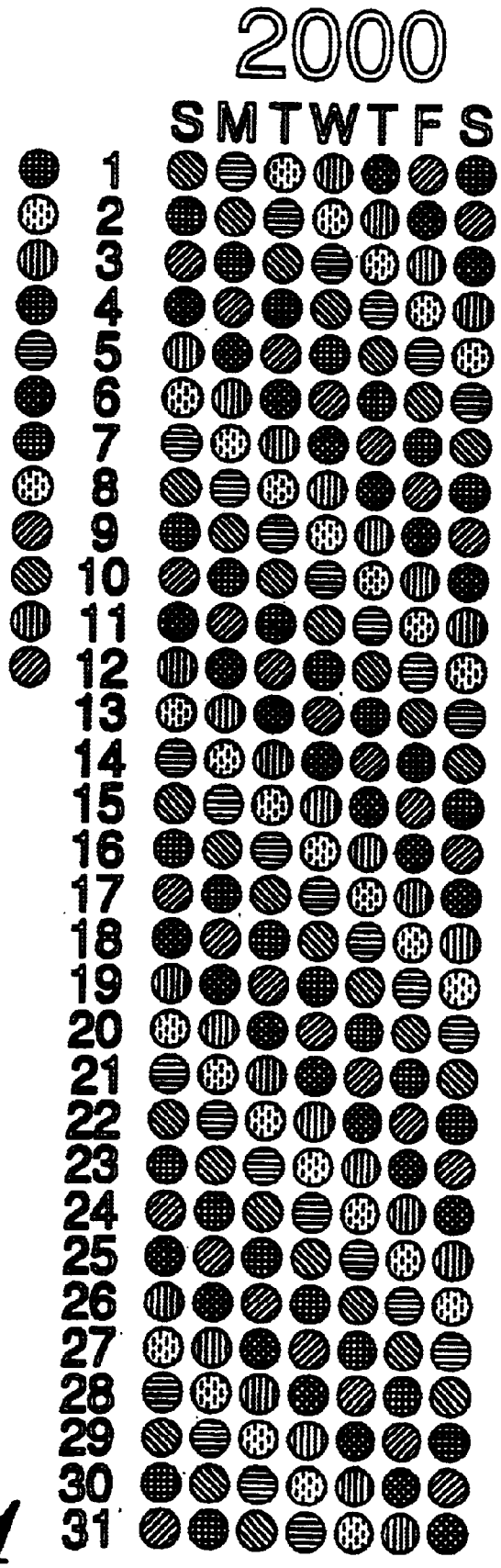
FIG. 1 is an example of a two dimensional symbol coded embodiment of the present invention showing a correlation of basic data for a month, date and day for any given year is shown.
Figure 2:
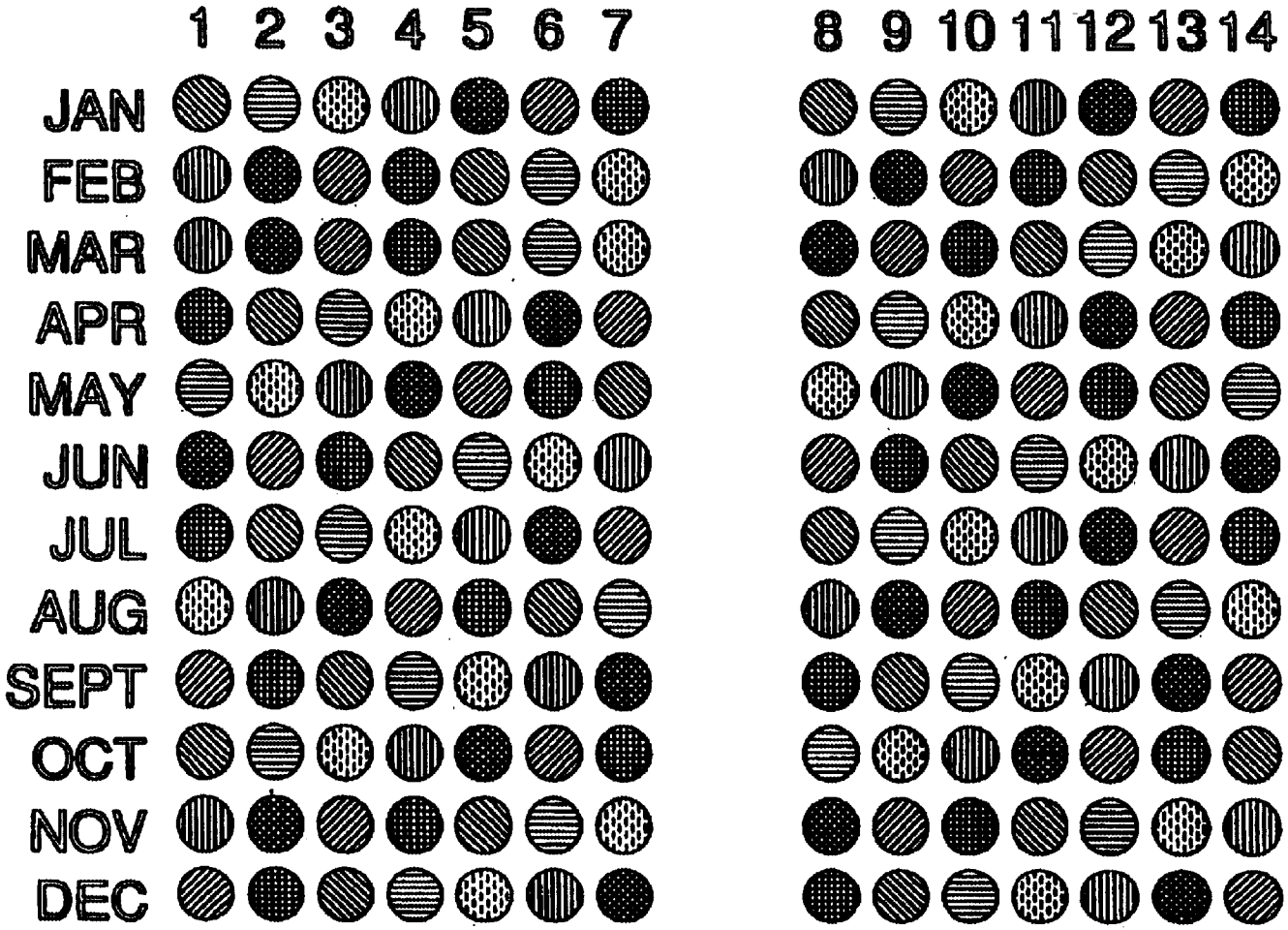
FIG. 2 is a selection display of month indicators for a perpetual annular calendar as shown in FIG. 1 usable for regular and leap years embodying features of the invention.

FIGS. 1 through 3 of the drawings disclose various embodiments and aspects of the present invention for purposes of illustration only. One skilled in the art will readily recognize from the following discussion that various alternate embodiments of the structures and methods offered herein for consideration may be employed without departing from the spirit or meaning of those operational principles which define the teachings of the present invention.

The present inventor has developed a calendaring means which can graphically present an entire year (for example, the year 2000 as shown in FIG. 1) in a concise easily readable matrix, effective for determining, in any order, the month, day and date for any given day in the year—including both leap years and standard years.

According to one embodiment of the present invention a two dimensional matrix presents the basic information of the month, date and day for a given year.

The invention can be manifested in several different embodiments including, but not limited to, a wall calendar, symbol or color coded diaries, electronic desk and electronic wall calendars, computer programs, and the like means for calendaring. In associated computer programs the symbols or colors can be replaced by an electronically recognizable signal corresponding to each color. However the screen image may still use a symbol or color scheme such as is disclosed.

In each embodiment recognizable symbols can be replaced by colors. In a preferred embodiment a means for calendaring is shown, with the year 2000 offered as an illustrative example. The novel enhanced visual impact of this preferred embodiment illustrates the passage of time without the crowded visual fields and redundancy generally ascribed to perpetual calendar schemes.

FIGS. 4–6 and 7*a*–7*n*, in combination, illustrate a 150 year calendar for the years 1901 through 2050.

The present invention contemplates graphic, electronic and software based applications of the instant teachings. Wall calendars ranging from miniature to poster-sized are a first embodiment. Likewise, desk calendars implemented in stand-alone form and in conjunction with desk pads and related desk top devices, such as ROLODEX® brand office products, are within the scope of the instant teachings.

Time manager systems are also appropriate for use with the present invention, including DAY TIMER® brand products, DAY RUNNER® brand products and those of the FRANKLIN® Company. The present invention can also be used as a second (back) side of advertising or promotional literature, disposed upon book marks, within the context of signed and limited editions with special mounting features, and in conjunction with various inks or finishes. Holographic applications of the instant teachings are further contemplated to be within the scope of the present invention.

An electronic version of the graphic calendar is embodied in the form of a perpetual calendar and digital clock. Its form is generally rectangular and resembles a monolithic sculptural entity, and the coded variables are illuminated variously according with preferences set by a user, while the current time and year data are available, for example, by toggle-means. Alternative versions allow highlighting or more brightly illuminating one or more of the current month, week or day at the election of the user.

Alternate preferred embodiments also include a time-based cascading of the involved symbols through either a random or systematized 'waterfall' of color, which may be programmed to perform a particular pattern at other predetermined times or settings, for example at noon or midnight. Both battery and solar power applications are contemplated, and a common logic drives both the calendar and the clock-means. Appropriately sized LED or lamp drivers which differ by being sized according to the task at hand allow for additional features to be added either through additional plug-in ASICS or equivalent, or through PROM or the like memory means. These embodiments further contemplate the use of recessed buttons on the side or rear enabling a user to set the time and date and other functions.

Referring now to FIG. 1, a first embodiment comprises a printed display which utilizes seven different symbols, each symbol representing a different color, each color, in turn, representing the seven possible different days for starting a month. The specific symbols, colors or combination of colors selected are not critical as long they can be readily distinguished by an observer. The spots are arranged in an array of 31 rows, for the dates of the month, and 7 columns set for the day of the week, each spot representing a particular day of the year. A second array sets forth 12 spots, each spot representing a month. The 12 spot array in FIG. 1 defines the calendar for the year 2000. In one example of use of the calendar, to find the calendar for a month, a spot representing that month, for example, the first spot in the 12 spot array representing the month of January, is located. Then that symbol is followed through the 31×7 array. In the preferred embodiment each different symbol stands for a different color. Referring to the first row of the 31×7 array of FIG. 1, the symbols, proceeding from left to right, represent, respectively: green, blue, purple, red, orange, light orange and yellow.

In another example, all of the months with day and date (for example, Friday the 13th) can be determined by noting the symbol or color of that date and day (green) on the 31×7 array and then identifying the month having the same symbol or color on the 12 spot array (October). The 31×7 array remains unchanged for all years but the symbol or color for each month (the 12 spot array) is different for each year, as specified by use of FIG. 2.

Referring still to FIG. 1, according to the illustrated embodiment, the year is designated at the top of the calendar. Each month is symbol or color coded and listed vertically from 1 to 12 in the far left column. According to the embodiment as illustrated, for example, the colors for the symbols for the year 2000 designate the month in accordance with the following legend:

| | | |
|---|---|---|
| 1 | January | yellow |
| 2 | February | purple |
| 3 | March | red |
| 4 | April | yellow |
| 5 | May | blue |
| 6 | June | orange |
| 7 | July | yellow |
| 8 | August | purple |
| 9 | September | light orange |
| 10 | October | green |
| 11 | November | red |
| 12 | December | light orange |

Certain symbols or colors represent more than one month (i.e., yellow represents January, April and July; purple represents February and August; red represents March and November). This indicates that those months represented by the same color all begin on the same day of the week. Of course any set of seven distinguishable colors can be used.

Referring still to FIG. 1, the present invention may be depicted on a laminated card specimen, labeled as shown for the year 2000. The format of the laminated card was designed specifically for the year 2000, but the concept can be used as a perpetual calendar and can cover standard years and leap years.

The format of the vertical 1 through 31 graphic indicia and horizontal Sunday through Saturday creates a two dimensional matrix which is fixed. Graphic indicia used in the matrix at the areas of intersection can be dots, pictures, embossed areas, graphic images or the like. The graphic indicia are likewise necessarily disposed within a fixed format. Further, any set of seven colors or indicia can be used.

Vertical graphic indicia in the form of dots on the upper left hand side of the laminated card are a code or legend which designate the months for the applicable year within the two dimensional matrix.

A perpetual calendar results from using the above described format by merely changing the month designation color coded in the left-hand vertical column. There are a total of 14 possible symbol or color sequences which can be used to adapt the calendar to represent any given year.

In other words, the 31×7 array remains constant, and the color for each month varies as a function of the matrix illustrated in FIG. 2 selected in coordination with FIG. 3.

Referring now to FIG. 2, January through December are illustrated along a vertical axis while the alternate symbol or colored circles are disposed across the remainder of the grid, with numbers 1–14 spanning the horizontal axis.

FIGS. 3*a* and 3*b* are to a table of the relationship between the numbers illustrated in FIG. 2, and the perpetual nature of the present invention. FIG. 3 identifies the selected 12 spot array for each regular and leap year from 1821–2080.

Figure 4:
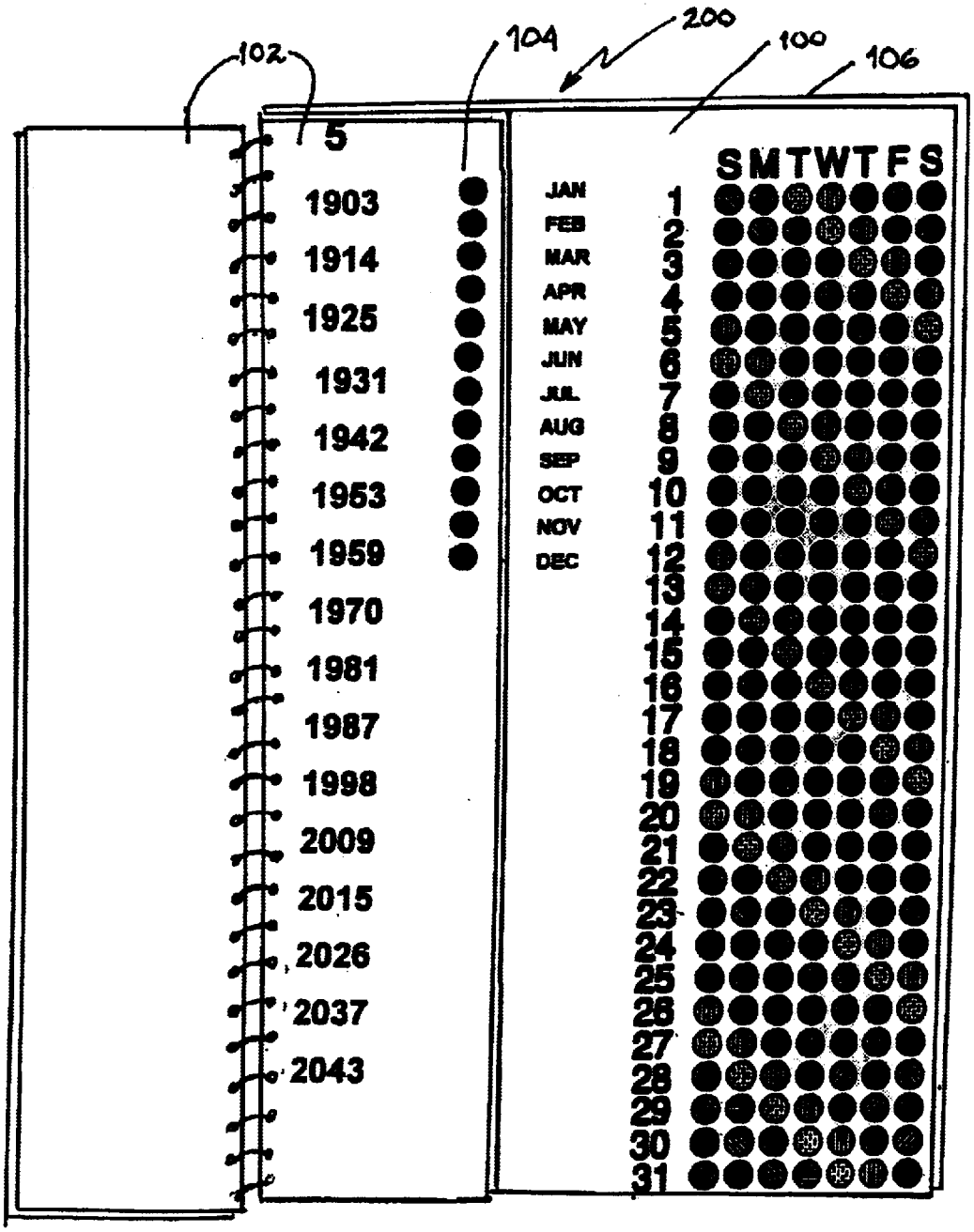
FIG. 4 is a perspective view of one example of a multiyear display of 16 years in a 150 year calendar.

As an example for the year 2000, FIG. 3 indicates the array 14 is to be used. Referring to FIG. 2 indicates selection of the 12 spot array shown in FIG. 1. FIG. 4 shows a portion of a 150 year multiyear calendar 200 usable for the years 1903, 1914, 1925, 1931, 1942, 1953, 1959, 1970, 1981, 1987, 1998, 2009, 2015, 2026, 2037 and 2043. The 150 year calendar 200 comprises a standard page 100, which is the right hand portion of FIG. 4, a set of 14 leafs 102 with years selected from FIG. 6 for selection of the appropriate leaf 102, shown arranged in book like fashion on the central and left hand portion of FIG. 4, and an array 104, (FIGS. 7*a*–7*n*) selected from FIG. 6 used FIG. 6 is shown in FIG. 4 as page 106 assembled below the standard page 100. Also shown in FIG. 4 are the 14 leafs 102 spirally bound on top of the standard page 100, the assembly opened to leaf number 5 (FIG. 7*e*) stacked on top of leaves number 6–14 (FIGS. 7*f*–7*n*). The left portion of FIG. 4 shows the back surfaces of leaves number 1–4 (FIGS. 7*a*–7*d*).

Referring to each of FIGS. 7*a*–7*n*, also referred to as leaves number 1–14, and FIG. 6, each of the leaves 102 can be generated using the array of FIG. 6. For example, in FIG. 6 the left column contains each of numbers 1–14, in some instances more than once. Moving horizontally across from number 5, the second column, in each instance, has a symbol which is the same, which is used to determine the day of the week of January 1 for each of the identified years listed horizontally to the right thereof in columns 3–8, which are in turn listed on FIG. 7*e*. Each of columes 3–7 show a full 28 year cycle; colum 8 shows only 10 of the 28 years. In the same manner each of FIGS. 7*a* –7*n* can be constructed. Each of FIGS. 7*a* –7*n* also have a vertical array of twelve symbols, starting with the symbol for January 1 of the specified years. This array also corresponds to the same vertical array in FIG. 2. It should be noted that every 300 years, i.e. for example, year 1900, 2200, 2500, etc. February 29 is dropped and therefore a FIG. 6 covering such a year would so indicate.

If one desired to view the calendar for the year 2009, one would first refer to the numerical array of FIG. 6 which directs the user to use leaf 5 (FIG. 7*e*). Once the Calendar is opened to leaf 5 (FIG. 4), it can be determined that Jan. 1, 2009 is a Wednesday. To identify the days of each subsequent month the symbol corresponding to the first day of each month is located next to the written abbreviation of each month. For example, June is represented in FIG. 4 by a circle with horizontal lines and, from the right portion it can be seen that June 1 is a Monday. Likewise Jul. 1, 2009 is a Wednesday. The days and dates for the remainder of June are determined by following the June symbol through the array on the standard page 100. The fact that June 31 does not exist can be determined because, according to FIG. 4, June 31 would be a Wednesday. However July 1 is a Wednesday so June must end on Tuesday Jun. 30, 2009.

Figure 5:
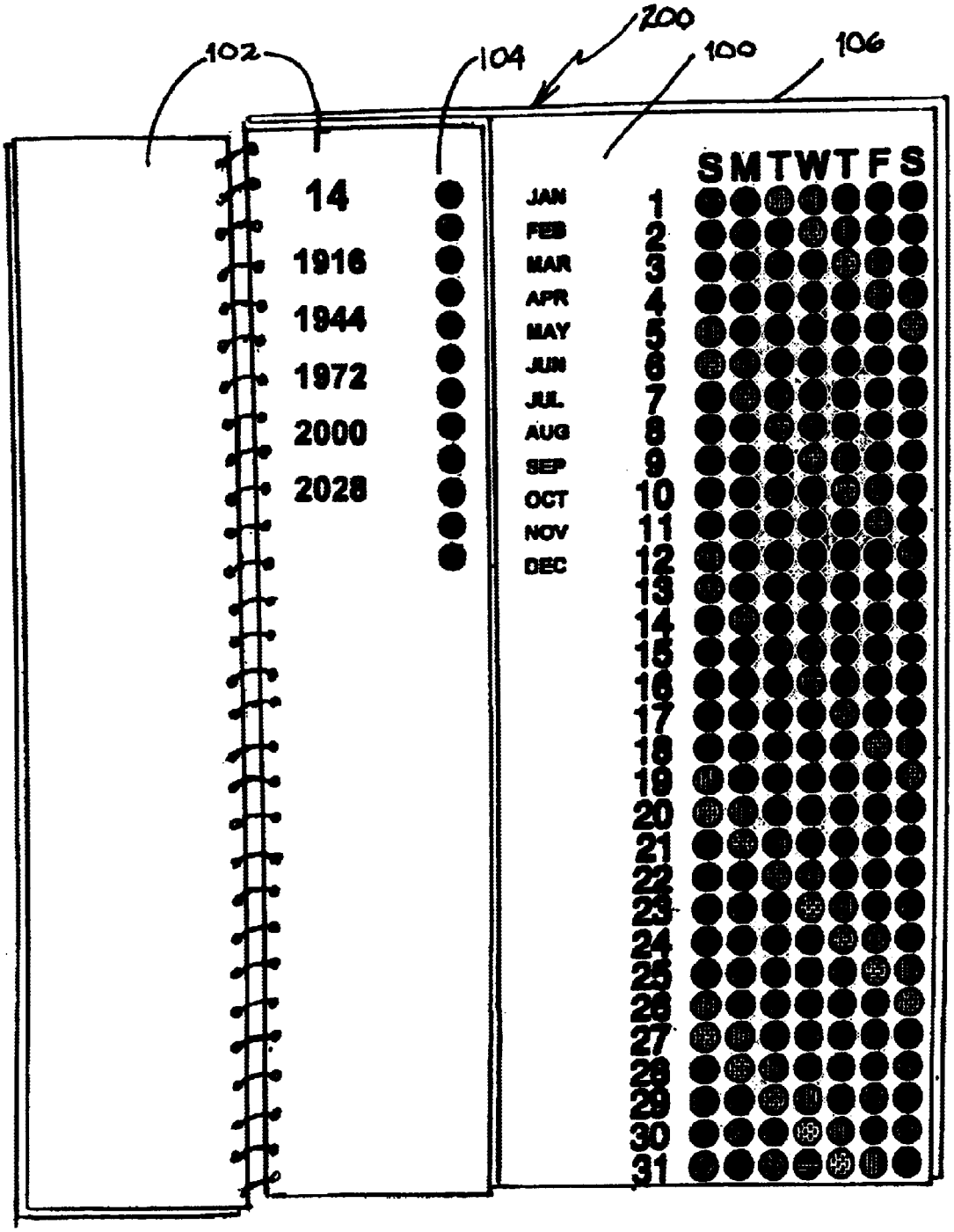
FIG. 5 shows a second example of a multiyear display of 5 leap years from the 150 year calendar.
Figure 1A:
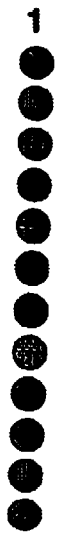
Figure 1B:
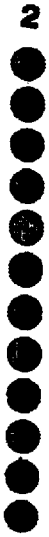
Figure 1C:
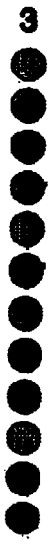
Figure 1D:
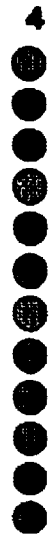
Figure 1E:
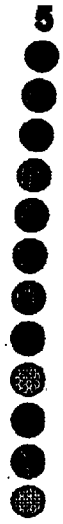
Figure 1F:
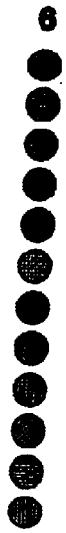
Figure 1G:
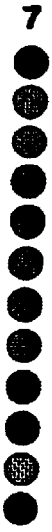
Figure 1H:
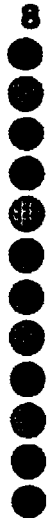
Figure 1I:
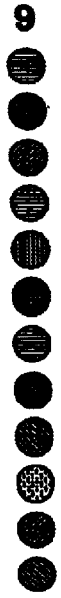
Figure 1J:
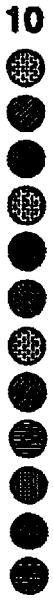
Figure 1K:
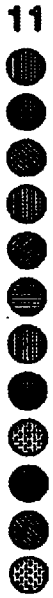
Figure 1L:
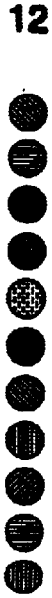
Figure 1M:
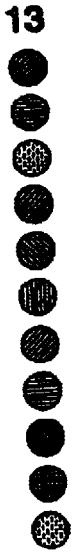
Figure 1N:
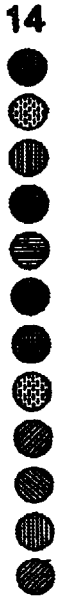

For a different year, for example 2000, the same procedure is followed. FIG. 6 indicates that leaf 14 (FIG. 7*n*) should be chosen. The leaves are turned until leaf number 14 appears, as shown in FIG. 5.

While FIGS. 4–6 and 7*a*–*n* are spirally bound to form a book, one skilled in the art will recognize that other binding methods (pins, glue bonding, etc) may be used or the components can be provided unassembled for the user to assemble in any manner desired. Further, one skilled in the art will recognize that the calendar assembly is not limited to the selected 150 years illustrated but may instead cover any range and number of years over any period of time.

Likewise, various computer-related and display modes are within the scope of the present invention For example, within the desk calendaring context, embodiments having various different ways of arraying the templates for the alternate years covered within the context of the present invention are known. These embodiments include various ways of changing the coded symbols for the desired years, such as templates, translucent overlays, and other ways of indicating the nature of the involved symbols to a user.

Alternate embodiments of the invention utilize the calendar either in a vertical or horizontal display, generated by a microprocessor in the form of an electronic calendar or by computer installed software. When the matrix is implemented by a computer, the programmed computer in one embodiment, can generate any desired display with the arrangement of the symbol matrix being the constant. To these ends, the symbols may be changed in response to an input instruction and a user can further coordinate that display with other time dependent information or activities also stored within a computer database or other accessible databases, such as by automated access to the world wide web, or related internet schemes.

For example, using a software based embodiment of the calendar, a user can select graphic indicia in the two dimensional matrix for a selected date and search that date for important historical events. The computer could hyperlink the selected date indicia to a search engine to display the data.

Alternatively, the software based embodiment would include planning capability dependent on selected date indicia.

During operation of a software based calendar incorporating features of the invention when a user selects an indicia, i.e., a particular spot calendar graphics and a menu bar are represented. Based on preselected user default settings which may be set as preferences, the users actuation of a particular symbol causes specific desired information to be offered for consideration.

A menu within the program would offer choices for users, as well as allow a user to change the color or shape of the dots or to substitute other indicia. An internal subroutine within the software ensuring that the relationship between the dots and the days is maintained. Likewise, the perpetual nature of the calendar based on the 14 possible color or indicia sequences is incorporated in the software.

In an alternate preferred embodiment the basic user interface is the calendaring graphic itself Each dot (or analogous symbol) when selected opens a new window. Content specific data streams are associated with the application desired by a users. A simple calendaring function exists in association with the base application. When a first application is added, a pull down menu will be accessible allowing the users to select an application to run in conjunction with the calendar. The calendar software can also be interfaced with the basic computer display so that, for example, the screen color changes with and reflects the color designating the month.

Likewise, the interface support has international applicability as it is not language dependent. However, language specific information can be imbedded in the software to preclude any concomitant impairment of base functions when language changes are implemented.

A user can modify the appearance of the calendaring means according to changes allowed by the base application. This permits a user to substitute any desired symbols or colors for any or all of the dots, to change the symbols (alternately pictures, graphics and frames are contemplated) for the dots. However, interactive customizing does not alter the basic calendaring function, nor does the selection of different years and the dot/month relationship change as different years are saved.

Different years are saveable with alternate arrays of colors and images, and an edit pull down menu bar is likewise used with the teachings of the present invention. The present invention is designed to be accessible through either a basic WINDOWS 95 format or the basic Macintosh OS window layout for APPLE® brand computers.

The base application permits a window to be opened when a date symbol is selected, the involved window is then available for use as a means for calendaring with various time formats available. Basic calendaring functions and other personalized data strings are likewise permitted.

The base application further permits other applications to be plugged in to the engine associated with the present invention. An interface is provided to link the date related aspects of the present invention with the calendar and to permit the application to be selected. Likewise, integrity checks for ensuring appropriate year matches are made with the time function operating as a critical variable.

The present invention connects a multiplicity of data strings which can be selected as a function of a fixed time or calendaring variables, and has utility for coordinating with data respecting age related activities, astrology, astronomy, cultural events, crossword puzzles, computer games, days in history, diet menus, educational events, ethnic menu, local, regional or national events, international events, exercise programs, family birthdays and anniversaries, famous birthdays, finance, health, hobby specific calendars (such as fishing or gardening), sport specific calendars, trade, travel, weather, and professional activity specific calendars, world affairs and any other user desired information.

The features and advantages described in the specification are neither comprehensive nor all inclusive, and in particular, many additional features, aspects and advantages of the present invention shall become apparent to an artisan of ordinary skill in the art in view of the drawings, specification, and the claims which are appended hereto with the scope, metes and bounds of the present invention be set forth in the appended claims.

I claim:

1. A multiyear calendar assembled from a standard page and multiple leaves moveably attached to cover at least a portion of the face of said standard page so as to expose a printed surface of one leaf at a time, the standard page having a first array of 217 coded symbols and a list of the months of the year arranged in a vertical column and in there normal order in any year, the first array comprising 7 columns, comprising the days of the week, and 31 rows, corresponding to the dates of the days in the week, each leaf having a second array comprising a set of coded symbols denoting months of the year and a list of the calendar years for which the leaf is appropriate, the second array of coded symbols arranged vertically and spaced so that when placed on top of the standard page each coded symbol of the second array is located adjacent its respective month listed on the standard page.

2. The multiyear calendar of claim 1 further including a numerical array listuing all of the years covered by the calendar and providing means for selecting the leaves corresponding to each year in the multiyear calendar.

* * * * *